United States Patent [19]

Thomas

[11] 4,045,034

[45] Aug. 30, 1977

[54] GOLF CLUB WEIGHTED ATTACHMENT

[76] Inventor: Lewis P. Thomas, Box 4116 Long Beach Branch, Long Beach, Calif. 90804

[21] Appl. No.: 587,338

[22] Filed: June 16, 1975

[51] Int. Cl.[2] ..... A63B 69/36

[52] U.S. Cl. ..... 273/194 B

[58] Field of Search ..... 273/32 R, 54 B, 171, 273/189 R, 189 A, 194 A, 194 B, 162 R; 128/DIG. 15; 272/96

[56] References Cited

U.S. PATENT DOCUMENTS

| | | | |
|---|---|---|---|
| 1,729,209 | 9/1929 | Curtice | 272/57 D X |
| 2,608,409 | 8/1952 | Pinkerton | 273/194 B |
| 2,676,803 | 4/1954 | Damaske | 273/194 B |
| 3,306,610 | 2/1967 | Biggs et al. | 272/57 D |
| 3,398,961 | 8/1968 | Higdon | 273/194 B |
| 3,427,020 | 2/1969 | Montour et al. | 272/57 D |
| 3,458,203 | 7/1969 | Mangis | 273/194 B |
| 3,490,766 | 1/1970 | Gardner | 272/67 X |
| 3,490,768 | 1/1970 | Archer | 272/67 X |
| 3,528,652 | 9/1970 | Tarbox | 272/57 D |
| 3,588,105 | 6/1971 | Donohoe | 273/54 B X |
| 3,716,239 | 2/1973 | Goudreau | 273/194 A |

*Primary Examiner*—Richard J. Apley
*Attorney, Agent, or Firm*—James E. Hawes

[57] ABSTRACT

The golf club weighted attachment is formed of a flexible sheet shaped to be wrapped about a golf club, the sheet including a weighted mass and means such as mating Velcro surfaces or snaps to removeably attach the sheet and the weighted mass it carries about a golf club. The weighted mass preferably is carried in narrow, elongated pockets formed in the sheet, the pockets being spaced to be in an opposed relationship when the attachment is affixed about a golf club. In one embodiment, the weighted mass is provided by relatively flat, pliant members, while in another embodiment granular material is carried in pockets that may be opened.

10 Claims, 4 Drawing Figures

GOLF CLUB WEIGHTED ATTACHMENT

BACKGROUND OF THE INVENTION

This invention relates to a golf club weighted attachment shaped and formed to be conveniently carried by a golfer and easily wrapped about a golf club to tone the golfer's muscles prior to a shot.

Many weighted attachments have been designed for golf clubs. It seems well established that they can be of significant assistance to the golfer, for when used not only do they warm up, loosen and tone the muscles required to properly swing a golf club, but they also tend to correct slight incoordinations in all of the various muscular movements required for such a swing. In addition, when affixed about the golf club head area known as the hosel, the weight addresses the golfer's attention to the golf club head. Also, it assists in firming the golfer's grip on the club and it encourages a smooth, continuous follow-through motion for a proper stroke. All of these features are of significant assistance to golfers in achieving distance, consistency, and accuracy in their shots. For these reasons, it would seem that such weights would be in wide use. Yet seldom are they seen on a golf course. The problems with previous designs of such weights generally include such things as their being difficult to carry and attach to the club, not being adaptable to different types of clubs or different golfers, not permitting the club to graze the ground and otherwise simulate a realistic stroke during the warm-up swings, and for the many such weights which are rigid, abrading the wrappings about the hosel.

The golf club weighted attachment disclosed herein is of definite assistance in solving all of these problems, and more.

SUMMARY OF THE INVENTION

The golf club weighted attachment is formed of a flexible sheet shaped to be wrapped about a golf club hosel area, the sheet including a weighted mass and means such as mating Velcro surfaces or snaps to removeably attach the sheet and the weighted mass it carries about a golf club. The weighted mass preferably is carried in narrow, elongated pockets formed in the sheet, the pockets being spaced to be in an opposed relationship when the attachment is affixed about a golf club hosel area. In one embodiment, the weighted mass is provided by relatively flat, pliant member, while in another embodiment granular material is carried in pockets that may be opened.

BRIEF DESCRIPTION OF THE DRAWINGS

The invention will be further described in connection with the accompanying drawings in which.

DETAILED DESCRIPTION

The golf club weighted attachment is designed to be removeably attached about either a golf club wood or iron. It is show in FIG. 1 attached about a golf club wood. This golf club consists of a shaft 2 and a head 4 the head being connected to the shaft in a shank or hosel section 6 about which is the standard wrapping.

Figure 2:
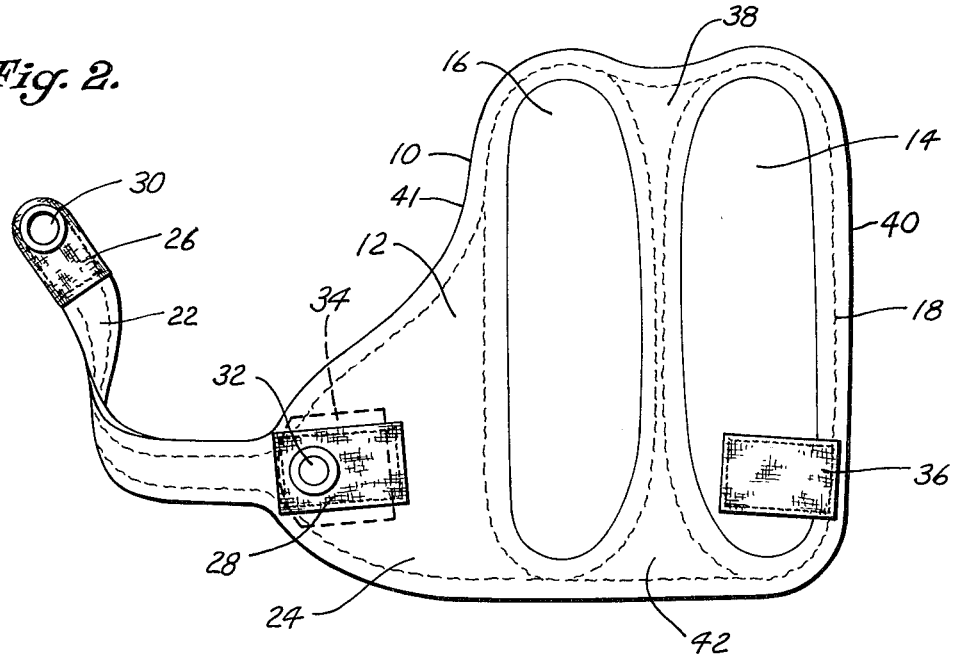
FIG. 2 is a plan view of the golf club weighted attachment.

The golf club attachment 10 is best shown in FIG. 2. It is formed of flexible sheet 12, incorporating pockets 14 and 16 that each receive a pliant, weighted member. The flexible sheet 12 preferably is formed from two pieces of leather or the like sewn together along the margin by stitching 18, the pockets also being outlined and defined by the stitching. A strap 22 is connected to an elongated tab section 24 provided in the sheet, the strap 22 bearing at its outer end a strip of Velcro material 26. A strip of mating Velcro material 28 is sewn to the tab section, preferably by the stitching that attaches the strap to the tab. Mating snaps may be provided in these areas, female snap 30 on the strap attaching to male snap 32 on the tab area. Also, preferably enlarged Velcro strips are provided on the tab section and overlying pocket 14, Velcro strip 34 on the tab underlying the strap and Velcro strip 28, and Velcro strip 36 overlying pocket area 14 as illustrated in FIG. 2.

Figure 1:
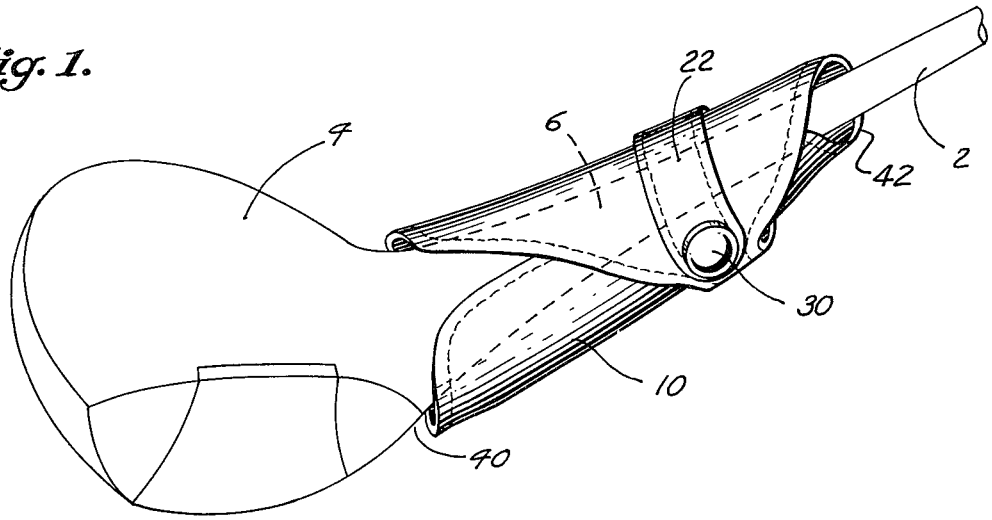
FIG. 1 is a perspective view of a golf club head carrying the golf club weighted attachment.
Figure 3:
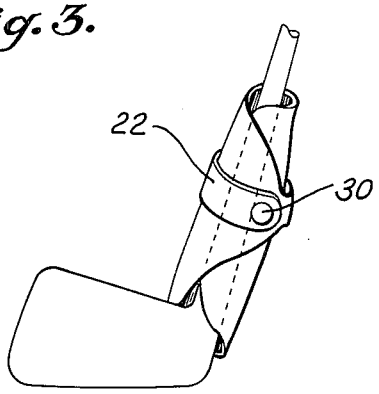
FIG. 3 is a horizontal view of another golf club head carrying the weighted attachment.

The attachment is shaped to fit snugly about almost any type of golf club, as shown in FIGS. 1 and 3. To this end, the attachment includes a foot section, indicated by reference character 38 in FIG. 2, that fits snugly about the heel 40 of the golf club, and a top portion 42 that is wrapped snugly about the golf club shaft. The foot section is relatively short, the edge of the sheet at the foot section being concave to fit about the heel portion of the golf club, as best shown in FIG. 2. The edge of the sheet which defines the top portion 42 is slightly convex and of sufficient length to wrap about the shaft of the club. The sheet also includes a first longitudinal side edge 40, this edge being slightly convex to fit along the shaft of the golf club, and a second longitudinal side edge 41, this edge including a concave portion which, when the sheet is wrapped about a golf club, overlies the heel portion of the club and causes the foot section of the sheet to remain above the plane defined by the bottom of the club. The foot section 38, the longitudinal side edges 40 and 41, and the top portion 42 define the four sides of the sheet. Weights 14 and 16 are shaped to diverge away from the foot section 38 somewhat, assisting in adapting the attachment to fit snugly about the heel of the golf club. Weights 14 and 16 also are slightly curved or warped about their longitudinal axes, again to fit closely about the hosel of the golf club.

To removeably attach the weighted sheet to a golf club, it is simply necessary to place weight 14 against the front side of the shaft and adjacent the club face with foot section 38 adjacent the heel of the club, then wrap the sheet about the back of side of the club causing weight 16 to lie against the back side of the club and tab section 24 to overlie weight 14. Velcro strips 34 and 36 are mated to hold the attachment in this position, then strap 22 wrapped about the hosel, Velcro strips 26 and 28 mated, and snaps 30 and 32 mated. This will firmly hold the attachment to the club, and resist the substantial forces exerted by a golfer during a swing, even the great forces exerted by a powerful golfer. Snaps 30 and 32, being designed to resist shear forces, are particularly effective in this regard.

When so attached, the golf club may be swung by the player to warm up and loosen the proper muscles for the forthcoming shots. This action also tones the proper muscles and tends to correct any slight incoordination in all the various muscular movements required for a proper shot. In addition, it firms the golfers grip on the club and tends to address his attention to the club head and assists in grooving the stroke for a smooth follow-through, all of which considerably assists the golfer in grooving his stroke to achieve distance and consistency in his shots.

Because of the shape of the attachment, it does not underlie the club head and thereby prevent or impede the club in brushing the ground as in a normal shot. It should also be noted that because of the shape and position of the weights, being relatively flat and lying adjacent either side of the club shaft, and being opposed to another on opposite sides of the club shaft, the force exerted by the weighted attachment during a warm-up swing is closely aligned with the axis of the shaft. After swinging the club sufficiently with the attachment, it may be removed simply by separating the snaps and Velcro strips while reversing the wrapping operation. Because of the shape of the attachment, it may be folded to easily fit in the golfers pocket or in an outer pocket of his golf bag to be conveniently accessible for the next shot. Also because of the shape of the attachment, it is flexible enough to be adaptable to a wide variety of clubs, including both a wood as shown in FIG. 1 and an iron as shown in FIG. 3, being attached about either type of club in the same fashion.

Figure 4:
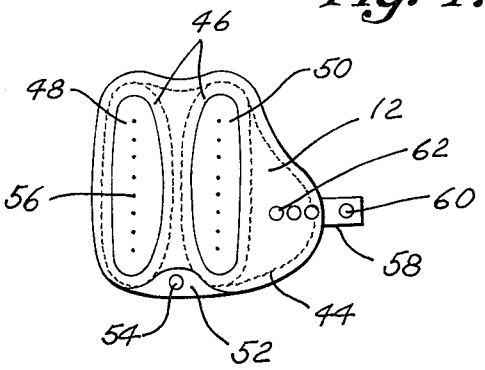
FIG. 4 is a plan view of a variation of the golf club weighted attachment.

In the embodiment shown in FIG. 2, weights 14 and 16 preferably are solid pieces of lead approximately 1/8⅛ thick. Such a material is sufficiently pliable to be bent to fit snugly about any club, and will naturally assume such a fit with minimum use. In some applications it may be preferred to provide an attachment, the weight of which may be adjusted. Such a variation is shown in FIG. 4. It includes a flexible sheet member 12 formed of two sheets of leather, plastic or the like, attached to one another about the margin areas and in regions 46 to define pocket areas 48 and 50. These pocket areas, however, are not attached at one end, the end adjacent a flap 52. This permits the flap to be opened and permit access to pocket areas and additional pieces of lead or weight of a granular character placed into the two pocket areas 48 and 50. This granular material conveniently may be B-B's, sand or the like. When the desired weight has been added or removed, flap 52 may be placed back over the sheet and snap 54 closed to close the pocket areas. Interconnecting elements 56, such as adhesive or fusion welds, stitching or internal bridges, are provided in to pocket areas to assist in properly defining their shape. An elastic tab 58 is provided at one side of the attachment. It includes a snap 60 that may be mated with snaps 62 provided in the area adjacent to the tab. This variation of the weighted attachment is placed about the club in a similar fashion to the attachment illustrated in FIG. 2, the elastic band overlying weighted pocket 48 and snaps 60 being snapped to one of the mating snaps 62.

Other variations of the weighted attachment are quite possible and will occur to those skilled in this art. Accordingly, the scope of the invention is defined by the following claims.

What is claimed is

1. The combination of a golf club and a weighted attachment adapted to be detachably secured thereto, the golf club including a shaft and a club head secured on one end of the shaft, the club head having an upwardly projecting hosel for receiving the shaft, the attachment including:

a. a flexible sheet shaped to be wrapped about the golf club hosel, the lower edge of the sheet defining a relatively short foot section, the edge of the foot section being shaped to fit about the heel portion of the club head, the sheet also having, b. a first longitudinal side edge shaped to fit along the shaft, c. a top portion, the edge along this portion being of sufficient length to wrap about the shaft, d. a weighted mass e. means attaching the weighted mass to the flexible sheet, f. a second longitudinal side edge of the sheet being configured to overlie the heel portion of the hosel, and g. securing the weighted sheet about the golf club, h. the foot section, longitudinal side edges and the top portion of the sheet defining the four sides of the sheet, i. the portion of the flexible sheet overlying the heel portion of the club causing the foot section of the sheet to remain above the plane of the bottom of the club.

2. The combination as set forth in claim 1 in which the weighted mass attaching means includes at least one narrow elongated pocket formed in the flexible sheet, the longitudinal axis of the pocket being generally parallel to the longitudinal axis of the golf club, the weighted mass being received in and carried by the pocket.

3. The combination as set forth in claim 2 in which the weighted mass attaching means includes two narrow, elongated pockets so shaped and spaced as to lie adjacent the golf club shaft and the hosel head in an opposed relationship when the flexible sheet is wrapped about a golf club.

4. The combination as set forth in claim 3 in which the weighted mass is formed of flat, pliant relatively heavy material and is shaped to fit against the golf club hosel.

5. The combination as set forth in claim 3 in which the weighted mass attaching means further includes means permitting the pockets to be opened and the amount of mass in each to be adjusted.

6. The combination as set forth in claim 3 in which the securing means includes a strap connected to the sheet for being wrapped about the golf club hosel, and means to connect the strap to the sheet when so wrapped about the golf club hosel to thereby removeably secure the attachment to a golf club.

7. The combination as set forth in claim 6 including mating snaps on the strap and the surface of the sheet it overlies when the attachment is removeably secured about the golf club.

8. The combination as set forth in claim 6 in which the removeably securing means includes mating Velcro strips on the strap and the area of the flexible sheet it overlies when the attachment is removeably secured about a golf club.

9. An attachment as set forth in claim 8 in which the flexible sheet is formed of two sheets of leather material connected to one another at their margins and about the areas defining the pockets for the weighted masses.

10. The combination as set forth in claim 1 in which the weighted mass is formed of flat, pliant, relatively heavy material, in which the securing means includes a strap connected to the sheet for being wrapped about the golf club hosel, and means including mating snaps and Velcro strips on the straps and the surface of the sheet it overlies to connect the strap and sheet when the attachment is so wrapped about the golf club hosel to thereby removeably secure the attachemt to the golf club.

* * * * *